US008960857B1

(12) United States Patent
Sung et al.

(10) Patent No.: US 8,960,857 B1
(45) Date of Patent: Feb. 24, 2015

(54) INKJET PRINT HEAD AND METHOD OF MANUFACTURING THE SAME

(71) Applicant: Samsung Display Co., Ltd., Yongin, Gyeonggi-Do (KR)

(72) Inventors: Woo-Yong Sung, Seoul (KR); A-Ram Lee, Hwaseong-si (KR); Tae-Gyun Kim, Seoul (KR); Tae-Woon Cha, Seoul (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 14/274,046

(22) Filed: May 9, 2014

(30) Foreign Application Priority Data

Dec. 6, 2013 (KR) ..... 10-2013-0151472

(51) Int. Cl.
*B41J 2/17* (2006.01)
*B41J 2/14* (2006.01)
*B41J 2/16* (2006.01)

(52) U.S. Cl.
CPC *B41J 2/1433* (2013.01); *B41J 2/16* (2013.01); *B41J 2/164* (2013.01)
USPC ..... 347/47

(58) Field of Classification Search
None
See application file for complete search history.

(56) References Cited

U.S. PATENT DOCUMENTS

| | | | | |
|---|---|---|---|---|
| 7,264,329 | B2 * | 9/2007 | Kato et al. | 347/20 |
| 7,857,430 | B2 | 12/2010 | Furukawa | |
| 8,123,330 | B2 | 2/2012 | Sakai et al. | |
| 8,240,819 | B2 | 8/2012 | Seki | |
| 8,469,489 | B2 | 6/2013 | Seki et al. | |
| 8,844,137 | B2 * | 9/2014 | Cai et al. | 29/890.1 |
| 2003/0052949 | A1 | 3/2003 | Watanabe | |
| 2004/0032466 | A1 | 2/2004 | Deguchi et al. | |
| 2007/0182767 | A1 | 8/2007 | Cha et al. | |
| 2011/0041336 | A1 | 2/2011 | Sim et al. | |
| 2011/0281967 | A1 | 11/2011 | Krawiec | |
| 2012/0133709 | A1 | 5/2012 | Seki et al. | |
| 2012/0139997 | A1 | 6/2012 | Bhowmik et al. | |
| 2012/0242749 | A1 | 9/2012 | Moorlag et al. | |
| 2013/0016157 | A1 | 1/2013 | Akici | |
| 2013/0027471 | A1 | 1/2013 | Rivas et al. | |

FOREIGN PATENT DOCUMENTS

| | | |
|---|---|---|
| JP | 2003-165224 A | 6/2003 |
| JP | 2006-007718 A | 1/2006 |
| JP | 2011-152654 A | 8/2011 |

* cited by examiner

*Primary Examiner* — Lamson Nguyen
(74) *Attorney, Agent, or Firm* — Cantor Colburn LLP

(57) ABSTRACT

An inkjet print head includes a main body including carbon allotrope, and an ink storage configured to store an ink and including a space defined in the main body. A protecting layer is on an inner surface of the main body, and includes parylene. An inorganic layer is on the protecting layer. An organic layer is on the inorganic layer.

20 Claims, 5 Drawing Sheets

INKJET PRINT HEAD AND METHOD OF MANUFACTURING THE SAME

This application claims priority to Korean Patent Application No. 10-2013-0151472, filed on Dec. 6, 2013, and all the benefits accruing therefrom under 35 U.S.C. §119, the contents of which are incorporated by reference herein in its entirety.

BACKGROUND

1. Field

Exemplary embodiments relate to an inkjet print head and a method of manufacturing the same. More particularly, exemplary embodiments relate to an inkjet print head having improved durability and a method of manufacturing the same.

2. Description of the Related Art

An industrial inkjet printer uses an ink, which may include a metal, such as copper, gold, silver or the like, and ceramic and polymer as well as dye. The inkjet printer is used for a method of direct printing on a substrate, a film, fabric, a display apparatus or the like used in various devices such as an industrial graphic display apparatus, a display apparatus, a solar cell or the like. Especially, the inkjet printer is being used for forming a color filter and an alignment layer for aligning liquid crystals, in a display device.

The inkjet printer requires a print head having super precision and high reliability to realize a fine printing. An inkjet print head using a micro electro mechanical system ("MEMS") process is being researched and developed. A nozzle part of the inkjet print head controlling an emission of the ink may be within the MEMS process, however, other parts may be assembled by an adhesive.

SUMMARY

A main body of an inkjet print head may be formed by a carbon allotrope such as graphite, to increase strength thereof. The carbon allotrope may be corrosion-resistant to an organic solvent of an ink, a cleaning agent or the like. However, the carbon allotrope has high porosity, so that the organic solvent may be absorbed in the main body, and the organic solvent from one ink may contaminant a subsequent ink used in the inkjet print head. Furthermore, a display quality of a display apparatus may be deteriorated by a carbon allotrope particle contaminant from the main body of the inkjet print head and/or a detached adhesive from assembled parts of the inkjet print head.

One or more exemplary embodiment provides an inkjet print head improving a durability and a display quality of a display panel by reducing preventing a main body of the inkjet print head from absorbing an organic solvent in an ink, a cleaning agent or the like.

One or more exemplary embodiment also provides a method of manufacturing the inkjet print head.

In accordance with an exemplary embodiment, an inkjet print head includes a main body, a protecting layer, an inorganic layer and an organic layer. The main body includes carbon allotrope, and the main body includes an ink storage configured to store an ink and including a space defined in the main body. The protecting layer is on an inner surface of the main body, and includes parylene. The inorganic layer is on the protecting layer. The organic layer is on the inorganic layer.

In an exemplary embodiment, the inkjet print head may further include an adhesive layer. The adhesive layer may be between the main body and the protecting layer. The adhesive layer may include silane.

In an exemplary embodiment, the adhesive layer may include at least one of 3-methacryloxypropyltrimethoxysilane and N-(2-aminoethyl)-3-aminopropyltrimethoxysilane.

In an exemplary embodiment, the carbon allotrope may be graphite.

In an exemplary embodiment, a thickness of the protecting layer may be within a range of about 1 micrometer (um) to about 5 micrometers (um).

In an exemplary embodiment, the protecting layer may include at least one of parylene C, parylene N, parylene D and parylene HT.

In an exemplary embodiment, a thickness of the inorganic layer may be within a range of about 10 nanometers (nm) to about 1 um.

In an exemplary embodiment, the inorganic layer may include at least one of aluminum oxide, titanium dioxide, zinc oxide and zirconium oxide.

In an exemplary embodiment, a thickness of the organic layer may be within a range of about 10 nm to about 1 um.

In an exemplary embodiment, the organic layer may include at least one of polyamide, nylon 6, nylon 6,6, polyethylene, polypropylene, polyurea, polythiourea, polyurethane, polyester, polyazomethine, aluminum alkoxide, zinc alkoxide and titanium alkoxide.

In an exemplary embodiment, the main body may further include an ink injecting part and a nozzle part. The ink injecting part may be configured to provide the ink to the space of the ink storage, and include a hole defined in the main body. The nozzle part may be on a lower surface of the ink storage, and emit the ink provided from the ink storage to an outside of the main body.

In an exemplary embodiment, the inkjet print head may further include a driving part on an outer surface of the main body, and configured to apply a power to the nozzle part such that the nozzle part emits the ink.

In an exemplary embodiment, the nozzle part may include a nozzle main body and a nozzle piezoelectric ceramic layer. The nozzle main body may include the carbon allotrope and may be connected to the ink storage. An opening may be defined in the nozzle main body and be configured to store the ink. The nozzle piezoelectric ceramic layer may be connected to the opening.

In an exemplary embodiment, the nozzle part may further include the protecting layer, the inorganic layer and the organic layer. The protecting layer may be on an inner surface of the nozzle main body and the piezoelectric ceramic layer. The protecting layer may include parylene. The inorganic layer may be on the protecting layer. The organic layer may be on the inorganic layer.

In accordance with an exemplary embodiment, a method of manufacturing an inkjet print head includes forming a protecting layer from a parylene dimer on a surface of a main body comprising carbon allotrope, depositing an inorganic layer on the protecting layer and depositing an organic layer on the inorganic layer.

In an exemplary embodiment, the carbon allotrope may be graphite.

In an exemplary embodiment, the method may further include coating an adhesive layer including at least one of 3-methacryloxypropyltrimethoxysilane and N-(2-aminoethyl)-3-aminopropyltrimethoxysilane, prior to forming the protecting layer.

In an exemplary embodiment, the forming the protecting layer may include heating the parylene dimer to decompose the parylene dimer into a parylene monomer, and polymerizing the parylene monomer on the surface of the main body.

In an exemplary embodiment, the inorganic layer may be deposited by atomic layer deposition ("ALD").

In an exemplary embodiment, the organic layer may be deposited by molecular layer deposition ("MLD").

In one or more exemplary embodiment, the main body of the inkjet print head may include three layers such as a protecting layer, an inorganic layer and an organic layer thereby reducing or effectively preventing an organic solvent from being absorbed by the main body. Thus, a durability and a display quality of a display panel, including an element formed using the inkjet print head, may be improved.

BRIEF DESCRIPTION OF THE DRAWINGS

The disclosure will become more apparent by describing in detailed exemplary embodiments thereof with reference to the accompanying drawings, in which.

DETAILED DESCRIPTION

Figure 1:
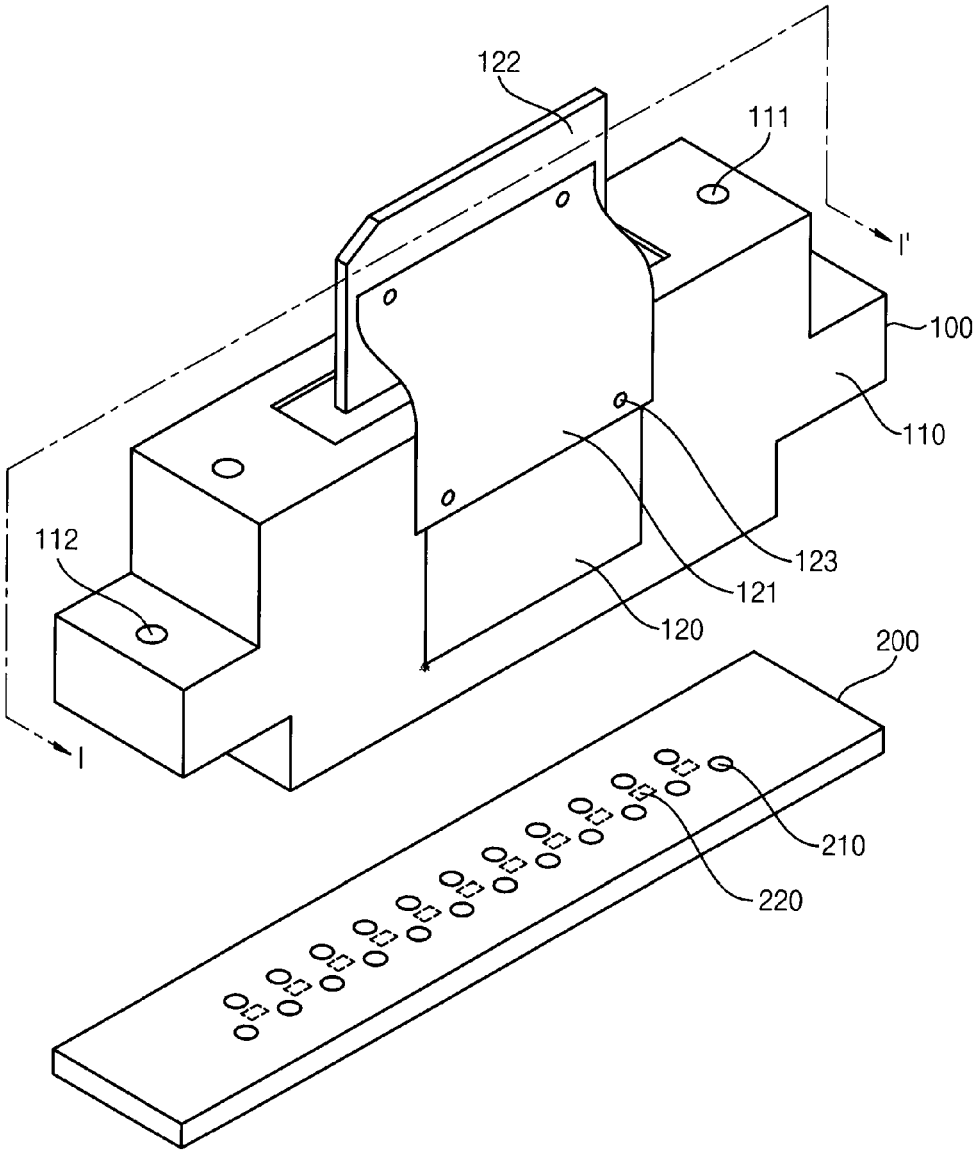
FIG. 1 is a perspective view illustrating an exemplary embodiment of an inkjet printer apparatus.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on" or "connected to" another element or layer, the element or layer can be directly on, connected or coupled to another element or layer or intervening elements or layers. In contrast, when an element is referred to as being "directly on" or "directly connected to" another element or layer, there are no intervening elements or layers present. As used herein, connected may refer to elements being physically, electrically and/or fluidly connected to each other. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "lower," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used in this specification, specify the presence of stated features, integers, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

Figure 2:
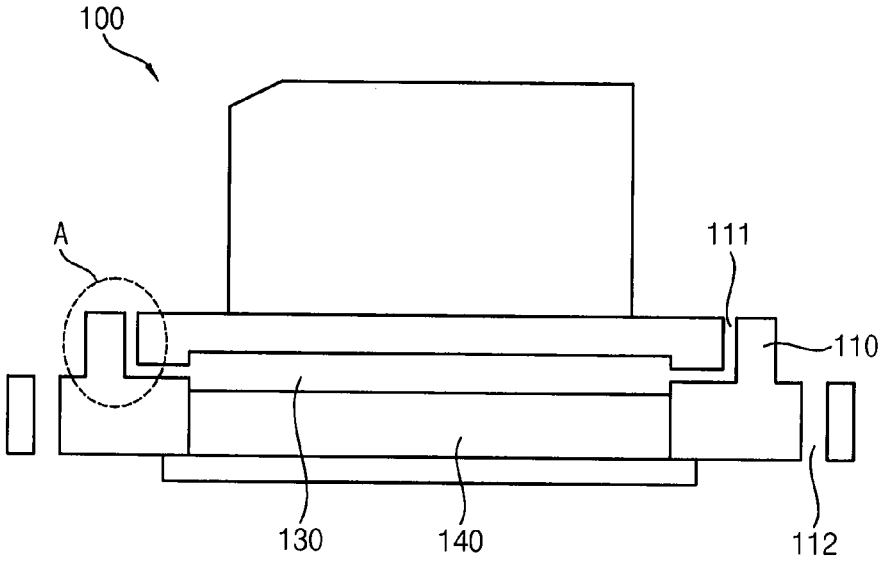
FIG. 2 is a cross-sectional view taken along line I-I' in FIG. 1.

FIG. 1 is a perspective view illustrating an exemplary embodiment of an inkjet printer apparatus. FIG. 2 is a cross-sectional view taken along line I-I' in FIG. 1.

Referring to FIGS. 1 and 2, an inkjet printer apparatus includes an inkjet print head 100 and a nozzle plate 200.

The inkjet print head 100 may include a main body 110 functioning as a print head frame, a driving part 120 disposed on a side surface of the main body 110, an ink storage 130 and a nozzle part 140.

The main body 110 may function as a frame of the print head. The main body 110 may have various shapes. In an exemplary embodiment, for example, the main body 110 may have a square pillar shape.

The main body 110 may include carbon allotrope. The carbon allotrope may be graphite. The graphite is a crystal of carbon atoms which may be formed by heating a carbonizable material to remove impurities adjacent to the carbon atoms.

The main body 110 may include an ink injecting part 111 disposed on opposing sides of the main body 110. A hole may be defined in the main body 110, thereby forming the ink injecting part 111. An ink, a cleaning agent or the like may be injected through the ink injecting part 111.

The main body 110 may include a combining hole 112 with which to combine the print head 100 with the nozzle plate 200.

The driving part 120 may be disposed on opposing sides of the main body 110. The driving part 120 may be configured to drive the nozzle part 140 such as by applying a power to the nozzle part 140. The driving part 120 may be electrically connected to a printed circuit board 122 by a flexible printed circuit board 121 ("FPCB").

The driving part 120 may include an integrated circuit having a plurality of transistors, resistances and/or capacitors on a silicon substrate. The driving part 120 may apply a power to the nozzle part 140, such that the nozzle part 140 emits an ink.

The flexible printed circuit board 121 may be disposed on an outer surface of the main body 110, and electrically connected to the driving part 120. The flexible printed circuit board 121 may apply the power for emitting the ink, to the driving part 120.

The flexible printed circuit board 121 may include a substrate which includes a circuit disposed on a flexible insulating film. The flexible insulating film may be a heat resisting plastic film including a flexible material, such as polyester, polyimide or the like. A plurality of the flexible printed circuit board 121 may be used as desired.

The printed circuit board 122 may generate a signal to drive the driving part 120. The printed circuit board 122 may be disposed on an upper surface of the inkjet print head 100 and electrically connected to the driving part 120 through the flexible printed circuit board 121.

The driving part 120, the flexible printed circuit board 121 and the printed circuit board 122 may be connected to each other by connecting elements 123. In an exemplary embodiment, for example, the connecting elements 123 may include a conductive material, such as copper ("Cu"), aluminum ("Al"), or the like.

The main body 110 may include the ink storage 130 configured to store the ink, which is provided from the ink injecting part 111. The ink storage 130 may be connected to the ink injecting part 111.

The ink storage 130 may be disposed and/or defined in the main body 110. The ink storage 130 may be disposed at a lower surface of the ink injecting part 111. The ink storage 130 may provide the ink to the nozzle part 140.

The main body 110 may include the nozzle part 140 which is configured to emit the ink provided from the ink storage 130, to an outside of the main body 110.

The nozzle part 140 may be disposed on a lower surface of the ink storage 130.

The nozzle part 140 may include a piezoelectric ceramic layer. In an exemplary embodiment, for example, the piezoelectric ceramic layer may include lead zirconate titanate ("PZT").

A detailed structure of the nozzle part 140 will be further described with reference to FIGS. 5 and 6.

The main body 110 may include a plurality of dispersion holes defined in a lower surface of the main body 110. The dispersion holes may disperse the ink emitted from the nozzle part 140. In an exemplary embodiment, for example, the number of the dispersion holes may be 128 or 256, but is not limited thereto.

The nozzle plate 200 may provide the ink from the inkjet print head 100, and may emit various sizes of the ink therefrom. The nozzle plate 200 may be disposed on a lower surface of the inkjet print head 100.

A plurality of nozzle upper holes 210 may be disposed on an upper surface of the nozzle plate 200. The nozzle plate 200 may provide the ink from the inkjet print head 100. In an exemplary embodiment, for example, the number of the nozzle upper holes 210 may be 128 or 256, but is not limited thereto. The ink may be emitted from a lower surface of the nozzle plate 200 opposite to the upper surface, via a plurality of nozzle lower holes 220 and an inner space of the nozzle plate 200. The plurality of nozzle upper and lower holes 210 and 220 are respectively defined in the upper and lower surfaces of the nozzle plate 200. The inner space of the nozzle plate 200 may be a flow channel for the ink, and may be connected to the nozzle upper and lower holes 210 and 220 at opposing ends thereof.

The nozzle plate 200 may include silicon or a metal. In an exemplary embodiment, for example, the nozzle plate 200 may be formed from silicon through a micro electro mechanical system ("MEMS") process. Alternatively, the nozzle plate 200 may be a conventional nozzle plate.

Figure 3:
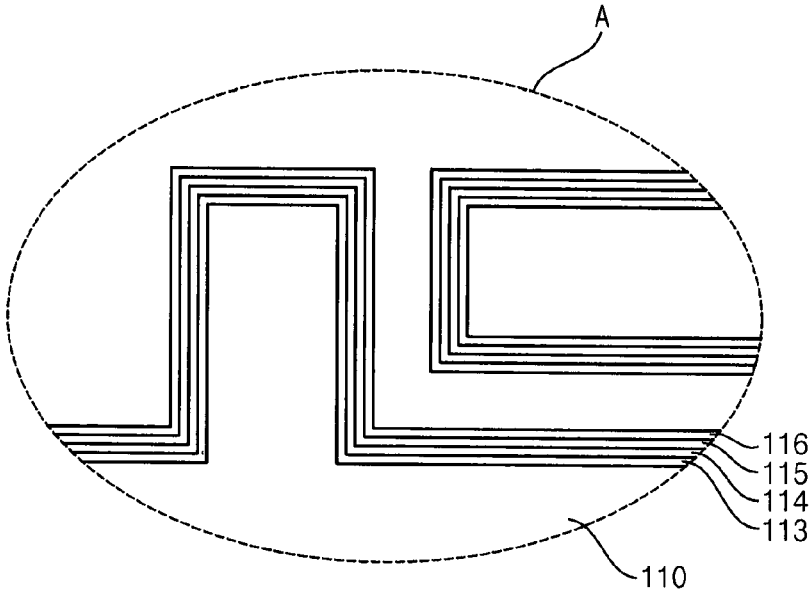
FIG. 3 is an enlarged cross-sectional view of region A in FIG. 2.

FIG. 3 is an enlarged cross-sectional view of region A in FIG. 2.

Referring to FIGS. 1 to 3, the inkjet print head 100 includes a main body 110, an adhesive layer 113, a protecting layer 114, an inorganic layer 115 and an organic layer 116.

The main body 110 may include carbon allotrope. The carbon allotrope may be graphite. The graphite is a crystal of carbon atoms which may be formed by heating a carbonizable material to remove impurities adjacent to the carbon atoms.

The graphite included in the main body 110 may have corrosion resistance to an organic solvent. However, the graphite has a high porosity, so that the ink may be absorbed in a pore space of the main body 110. Furthermore, the graphite may include powder, which may flow into the ink passing through the main body to undesirably appear on a layer formed from the ink.

The adhesive layer 113 may be disposed on the main body 110.

In an exemplary embodiment, for example, the adhesive layer 113 may include 3-methacryloxypropyltrimethoxysilane, N-(2-aminoethyl)-3-aminopropyltrimethoxysilane or the like. These can be used each alone or in a combination thereof.

The protection layer 114 may be disposed on an inner surface and an outer surface of the main body 110. An inner surface of the main body 110 may be a surface which defines the ink injecting part 111 and/or the ink storage 130. The protection layer 114 may fill pores extending inward from the inner and outer surfaces of the main body 110, thereby effectively surrounding the surfaces of the main body 110. Thus, the protection layer 114 may flatten or planarize the surfaces of the main body 110 including the carbon allotrope. Furthermore, the protection layer 114 may reduce or effectively prevent the powder of the main body 110 from smearing.

In an exemplary embodiment, for example, a thickness of the protecting layer 114 may be within a range of about 1 micrometer (um) to about 5 micrometers (um). When the thickness of the protecting layer 114 is less than 1 um, the surface of the main body 110 may not be flattened. When the thickness of the protecting layer 114 is more than 5 um, a width of the ink injecting part 111 and/or the nozzle part 140 may be too narrow, so that a supply of the ink may be restricted. The thickness is taken in a direction normal to the surface from which the thickness is defined.

In an exemplary embodiment, for example, the protecting layer 114 may include a parylene, also known as poly (p-xylylene) polymers. The parylene may be at least one of parylene N, parylene C, parylene D, parylene HT or the like. These can be used each alone or in a combination thereof.

The parylene N may be a polymer represented by Chemical Formula 1. The parylene N may also be known as poly-p-xylylene.

[Chemical Formula 1]

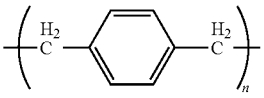

The protecting layer 114 including the parylene N may be formed by a dimer represented by Chemical Formula 2. The dimer may be heated to form a radical intermediate. The radical intermediates may react with each other, thereby forming the protecting layer 114.

[Chemical Formula 2]

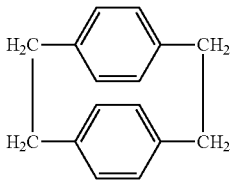

The parylene C may be polymer represented by Chemical Formula 3. The parylene C may also be known as poly-2-chloro-p-xylylene.

[Chemical Formula 3]

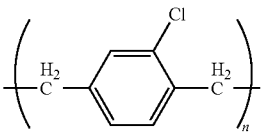

The protecting layer 114 including the parylene C may be formed by a dimer represented by Chemical Formula 4.

[Chemical Formula 4]

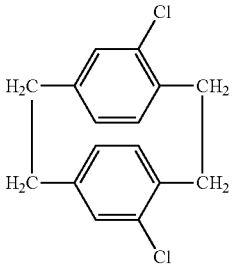

The parylene D may be polymer represented by Chemical Formula 5. The parylene D may also be known as poly-2,5-dichloro-p-xylylene.

[Chemical Formula 5]

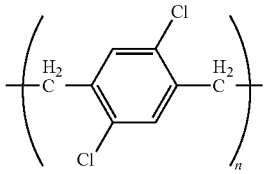

The protecting layer 114 including the parylene D may be formed by a dimer represented by Chemical Formula 6.

[Chemical Formula 6]

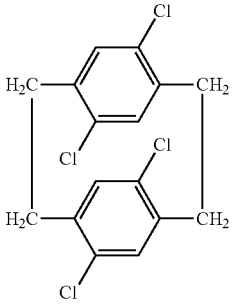

The parylene HT may be polymer represented by Chemical Formula 7. The parylene HT may be named as poly-tetrafluoro-p-xylylene.

[Chemical Formula 7]

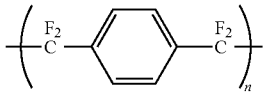

The protecting layer 114 including the parylene HT may be formed by a dimer represented by Chemical Formula 8.

[Chemical Formula 8]

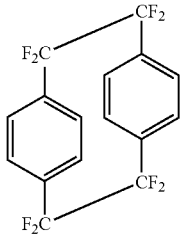

The inorganic layer 115 may be disposed on the protecting layer 114.

The inorganic layer 115 may reduce or effectively prevent the organic solvent of the ink, or the cleaning agent, from being absorbed by the main body 110. In an exemplary embodiment of manufacturing an inkjet print head 100, the inorganic layer 115 may be deposited on the protection layer 114 by atomic layer deposition ("ALD") process.

In one exemplary embodiment, for example, a thickness of the inorganic layer 115 may be within a range of about 10 nanometers (nm) to about 1 um. When the thickness of the inorganic layer 115 is less than 10 nm, a density of the inorganic layer 115 may be low. When the thickness of the inorganic layer 115 is more than 1 um, a width of the ink injecting part 111 and/or the nozzle part 140 may be too narrow, so that a supply of the ink may be restricted.

In an exemplary embodiment, for example, the inorganic layer 115 may include aluminum oxide, titanium dioxide, zinc oxide, zirconium oxide or the like. These can be used each alone or in a combination thereof.

The organic layer 116 may be disposed on the inorganic layer 115.

The organic layer 116 may reduce or effectively prevent the organic solvent of the ink, or the cleaning agent, from being absorbed by the main body 110. Furthermore, the organic layer 116 may be flexible, so that the organic layer 116 may reduce or effectively prevent a crack in the inorganic layer 115. In an exemplary embodiment of manufacturing an inkjet print head 100, the organic layer 116 may be deposited on the inorganic layer 115 by molecular layer deposition ("MLD") process.

In an exemplary embodiment, for example, a thickness of the organic layer 116 may be within a range of about 10 nm to about 1 um. When the thickness of the organic layer 116 is less than 10 nm, a flexibility of the organic layer 116 may be low. When the thickness of the organic layer 116 is more than 1 um, a width of the ink injecting part 111 and/or the nozzle part 140 may be too narrow, so that a supply of the ink may be restricted.

In an exemplary embodiment, for example, the organic layer 116 may include polyamide, nylon 6, nylon 6,6, polyethylene, polypropylene, polyurea, polythiourea, polyurethane, polyester, polyazomethine, aluminum alkoxide, zinc alkoxide, titanium alkoxide or the like. These can be used each alone or in a combination thereof.

FIGS. 4A to 4D are enlarged cross-sectional views illustrating an exemplary embodiment of manufacturing an inkjet print head in FIG. 2. The views correspond to the region A in FIG. 2.

Referring to FIGS. 1 to 4D, an adhesive layer 113 may be coated on an inner surface and an outer surface of the main body 110. A parylene dimer may be heated, thereby forming a protecting layer 114 on the adhesive layer 113. An inorganic layer 115 may be deposited on the protecting layer 114. An organic layer 116 may be deposited on the inorganic layer 115.

For example, the adhesive layer 113 may include 3-methacryloxypropyltrimethoxysilane and N-(2-aminoethyl)-3-aminopropyltrimethoxysilane. These can be used each alone or in a combination thereof.

The protecting layer 114 may be formed on the adhesive layer 113.

In an exemplary embodiment, for example, the protecting layer 114 may include at least one of parylene N, parylene C, parylene D and parylene HT.

The protecting layer 114 including the parylene N may be formed by a dimer represented by Chemical Formula 2. The protecting layer 114 including the parylene C may be formed by a dimer represented by Chemical Formula 4. The protecting layer 114 including the parylene D may be formed by a dimer represented by Chemical Formula 6. The protecting layer 114 including the parylene HT may be formed by a dimer represented by Chemical Formula 8.

The parylene dimer may be heated, thereby decomposing into parylene monomers. The decomposed parylene monomers may be polymerized on the main body 110. Therefore, the protection layer 114 may be formed on the main body 110.

Generally, the parylene dimer may have powder form. Thus, the parylene dimer may be injected into a vaporizer, and heated in a temperature within a range of about 120 degrees Celsius (° C.) to about 180° C. to be vaporized into a gas phase.

The parylene dimer may pass through a pyrolyzer, which is heated to a temperature of about 650° C. to about 700° C., so that the parylene dimer may be pyrolysed into the parylene monomer in the form of a radical intermediate. The parylene monomer may be polymerized in a deposition chamber, for example, under a pressure of 0.1 torr and a temperature of room temperature, thereby forming the protecting layer 114.

The inorganic layer 115 may be deposited by the ALD process. Thus, the inorganic layer 115 may be deposited on the protecting layer 114.

The organic layer 116 may be deposited by the MLD process. Thus, the organic layer 116 may be deposited on the inorganic layer 115.

Figure 5:
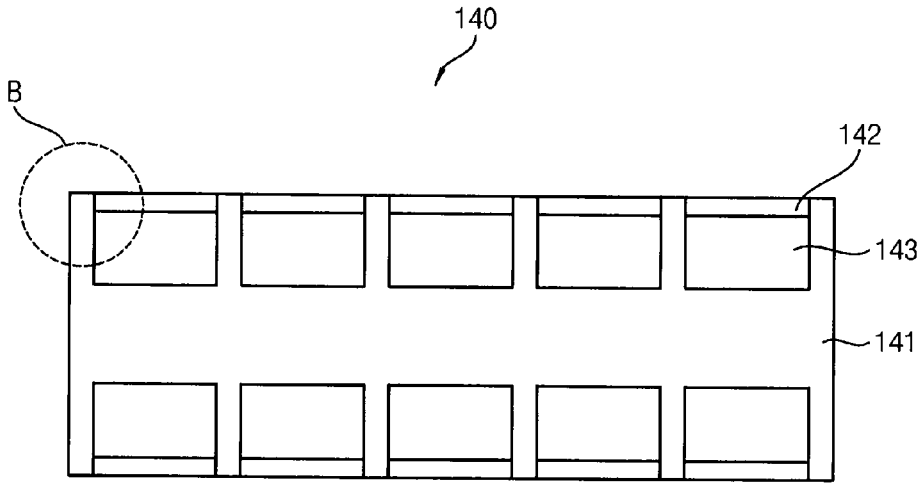
FIG. 5 is a plan view illustrating an exemplary embodiment of a nozzle part of an inkjet print head.
Figure 6:
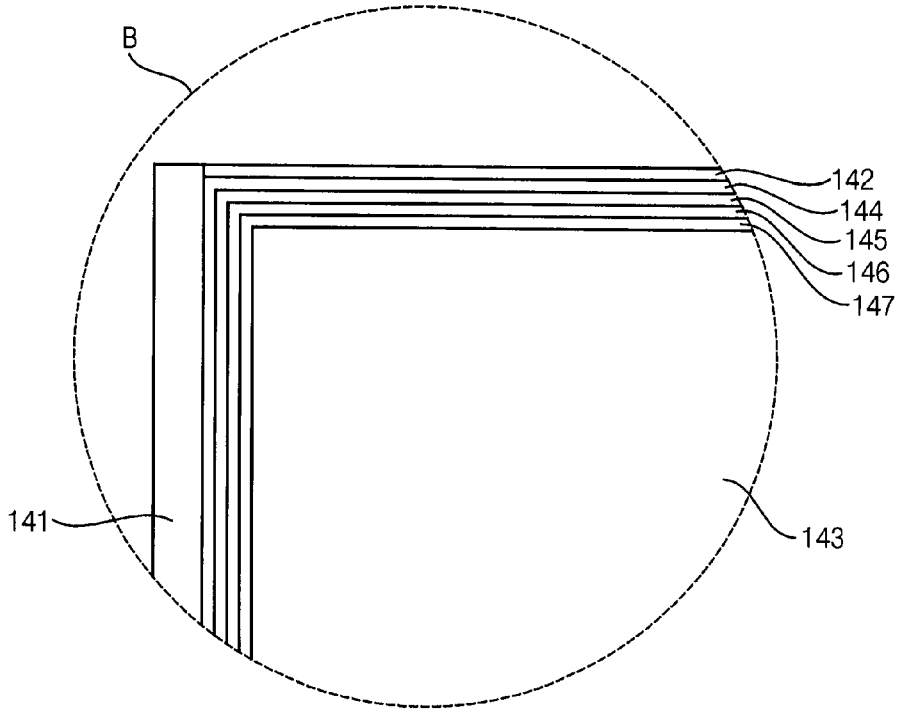
FIG. 6 is an enlarged cross-sectional view of region B in FIG. 5.

FIG. 5 is a plan view illustrating an exemplary embodiment of a nozzle part of an inkjet print head. FIG. 6 is an enlarged cross-sectional view of region B in FIG. 5.

Referring to FIGS. 1 to 6, a nozzle part 140 of the inkjet print head includes a nozzle main body 141, a piezoelectric ceramic layer 142, an ink emitting part 143, a nozzle adhesive layer 144, a nozzle protecting layer 145, a nozzle inorganic layer 146 and a nozzle organic layer 147.

Figure 4A:
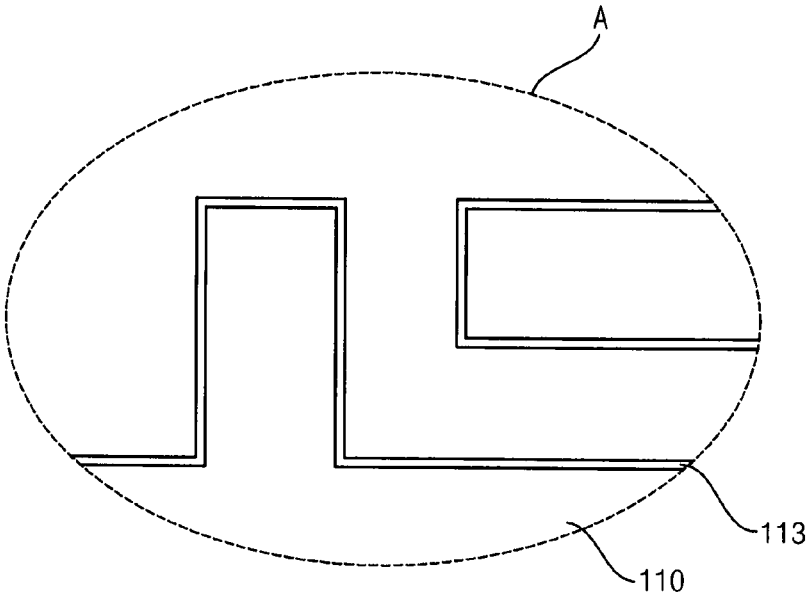
FIGS. 4A to 4D are enlarged cross-sectional views illustrating an exemplary embodiment of manufacturing the inkjet print head in FIG. 2.
Figure 4B:
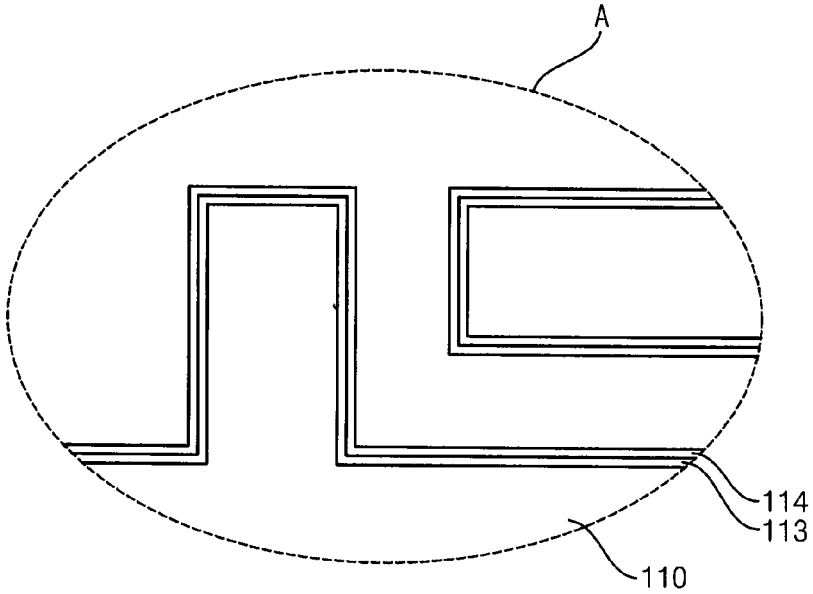
Figure 4C:
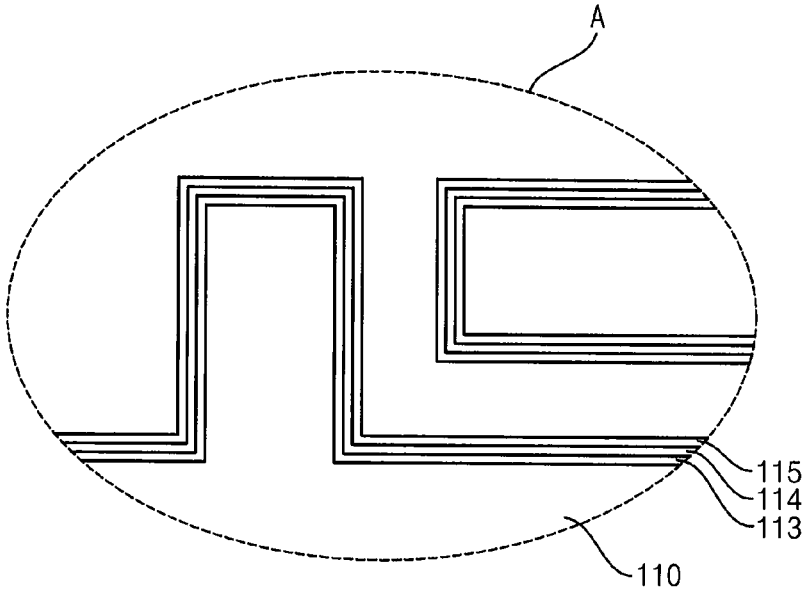
Figure 4D:
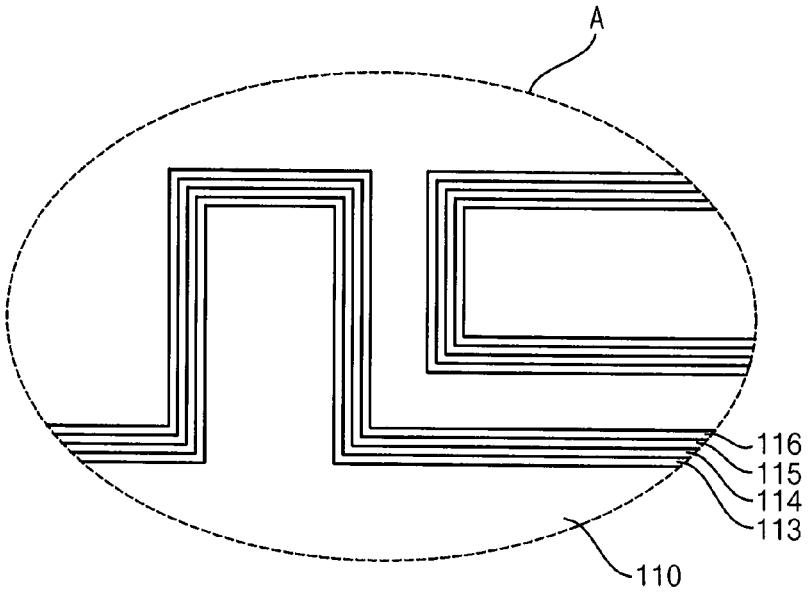

An exemplary embodiment of a method of manufacturing the nozzle part 140 is substantially the same as the method illustrated in FIGS. 3 to 4D. Thus, the nozzle adhesive layer 144, the nozzle protecting layer 145, the nozzle inorganic layer 146 and the nozzle organic layer 147 disposed on the nozzle main body 141 are substantially same as the adhesive layer 113, the protecting layer 114, the inorganic layer 115 and the organic layer 116 described in the previous exemplary embodiment in FIGS. 3 to 4D. Any further repetitive explanation concerning the above elements will be omitted.

The nozzle main body 141 may include carbon allotrope. The carbon allotrope may be graphite.

The nozzle piezoelectric ceramic layer 142 may transfer electrical energy of voltages into mechanical energy, thereby applying a pressure to an ink in the ink emitting part 143. The nozzle piezoelectric ceramic layer 142 may press the ink, which is filled in the nozzle part 140, so that the ink may be emitted from a lower surface of the nozzle part 140.

In an exemplary embodiment, for example, the nozzle piezoelectric ceramic layer 142 may include PZT.

The ink emitting part 143 may be surrounded by the nozzle main body 141 and the nozzle piezoelectric ceramic layer 142, such that the ink emitting part 143 may be defined by portions of the nozzle main body 141 and the nozzle piezoelectric ceramic layer 142. The ink in the ink emitting part 143 may be pressed by the nozzle piezoelectric ceramic layer 142, thereby emitting the ink.

The nozzle adhesive layer 144 may be disposed on the nozzle main body 141.

In an exemplary embodiment, for example, the nozzle adhesive layer 144 may include 3-methacryloxypropyltrimethoxysilane, N-(2-aminoethyl)-3-aminopropyltrimethoxysilane or the like. These can be used each alone or in a combination thereof.

The nozzle protection layer 145 may be disposed on an inner surface and an outer surface of the nozzle main body 141. The nozzle protection layer 145 may fill the pores extending inward from the inner and outer surfaces of the nozzle main body 141, thereby effectively surrounding the surfaces of the nozzle main body 141. Thus, the nozzle protection layer 145 may flatten or planarize the surfaces of the nozzle main body 141 including the carbon allotrope. Furthermore, the nozzle protection layer 145 may reduce or effectively prevent the powder of the nozzle main body 141 from smearing.

In an exemplary embodiment, for example, a thickness of the nozzle protecting layer 145 may be within a range of about 1 um to about 5 um. When the thickness of the nozzle protecting layer 145 is less than 1 um, the surface of the nozzle main body 141 may not be flattened. When the thickness of the nozzle protecting layer 145 is more than 5 um, a width of the ink emitting part 143 may be too narrow, so that a supply of the ink may be restricted.

In an exemplary embodiment, for example, the protecting layer 114 may include parylene N, parylene C, parylene D, parylene HT or the like. These can be used each alone or in a combination thereof.

The parylene N may be polymer represented by Chemical Formula 1. The parylene N may also be known as poly-p-xylylene.

The parylene C may be polymer represented by Chemical Formula 3. The parylene C may also be known as poly-2-chloro-p-xylylene.

The parylene D may be polymer represented by Chemical Formula 5. The parylene D may also be known as poly-2,5-dichloro-p-xylylene.

The parylene HT may be polymer represented by Chemical Formula 7. The parylene HT may also be known as poly-tetrafluoro-p-xylylene.

The nozzle inorganic layer 146 may be disposed on the nozzle protecting layer 145.

The nozzle inorganic layer 146 may reduce or effectively prevent the organic solvent of the ink, or the cleaning agent, from being absorbed by the nozzle main body 141. The nozzle inorganic layer 146 may be deposited on the nozzle protection layer 145 by the ALD process.

In an exemplary embodiment, for example, a thickness of the nozzle inorganic layer 146 may be within a range of about 10 nm to about 1 um. When the thickness of the nozzle inorganic layer 146 is less than 10 nm, a density of the nozzle inorganic layer 146 may be low. When the thickness of the nozzle inorganic layer 146 is more than 1 um, a width of the ink emitting part 143 may be too narrow, so that a supply of the ink may be restricted.

In an exemplary embodiment, for example, the nozzle inorganic layer 115 may include aluminum oxide, titanium dioxide, zinc oxide, zirconium oxide or the like.

The nozzle organic layer 147 may be disposed on the nozzle inorganic layer 146.

The nozzle organic layer 147 may reduce or effectively prevent the organic solvent of the ink, or the cleaning agent, from being absorbed by the nozzle main body 141. The nozzle piezoelectric ceramic layer 142 may be repeatedly deformed or bent by voltages applied from the driving part 120, so that a crack may be generated in the inorganic layer 146. However, the nozzle organic layer 147 may be flexible, so that the nozzle organic layer 147 may prevent a crack in the nozzle inorganic layer 146.

The nozzle organic layer 147 may be deposited on the nozzle inorganic layer 146 by the MLD process.

In an exemplary embodiment, for example, a thickness of the nozzle organic layer 147 may be within a range of about 10 nm to about 1 um. When the thickness of the nozzle organic layer 147 is less than 10 nm, a flexibility of the nozzle organic layer 147 may be low. When the thickness of the nozzle organic layer 147 is more than 1 um, a width of the ink emitting part 143 may be too narrow, so that a supply of the ink may be restricted.

In an exemplary embodiment, for example, the nozzle organic layer 147 may include polyamide, nylon 6, nylon 6,6, polyethylene, polypropylene, polyurea, polythiourea, polyurethane, polyester, polyazomethine, aluminum alkoxide, zinc alkoxide, titanium alkoxide or the like. These can be used each alone or in a combination thereof.

One or more exemplary embodiment of the invention may be used for an inkjet printer apparatus for emitting an ink, but is not limited thereto.

The foregoing is illustrative of the invention and is not to be construed as limiting thereof. Although a few exemplary embodiments have been described, those skilled in the art will readily appreciate from the foregoing that many modifications are possible in the exemplary embodiments without materially departing from the novel teachings and advantages of the invention. Accordingly, all such modifications are intended to be included within the scope of the invention. In the claims, means-plus-function clauses are intended to cover the structures described herein as performing the recited function and not only structural equivalents but also functionally equivalent structures.

What is claimed is:

1. An inkjet print head, comprising:

a main body comprising carbon allotrope, and an ink storage configured to store an ink and comprising a space defined in the main body;

a protecting layer on an inner surface of the main body, and comprising parylene;

an inorganic layer on the protecting layer; and an organic layer on the inorganic layer.

2. The inkjet print head of claim 1, further comprising:

an adhesive layer between the main body and the protecting layer, and comprising silane.

3. The inkjet print head of claim 2, wherein the adhesive layer comprises at least one of 3-methacryloxypropyltrimethoxysilane and N-(2-aminoethyl)-3-aminopropyltrimethoxysilane.

4. The inkjet print head of claim 1, wherein the carbon allotrope is graphite.

5. The inkjet print head of claim 1, wherein a thickness of the protecting layer is within a range of about 1 micrometer to about 5 micrometers.

6. The inkjet print head of claim 5, wherein the protecting layer comprises at least one of parylene C, parylene N, parylene D and parylene HT.

7. The inkjet print head of claim 1, wherein a thickness of the inorganic layer is within a range of about 10 nanometers to about 1 micrometer.

8. The inkjet print head of claim 1, wherein the inorganic layer comprises at least one of aluminum oxide, titanium dioxide, zinc oxide and zirconium oxide.

9. The inkjet print head of claim 1, wherein a thickness of the organic layer is within a range of about 10 nanometers to about 1 micrometer.

10. The inkjet print head of claim 1, wherein the organic layer comprises at least one of polyamide, nylon 6, nylon 6,6, polyethylene, polypropylene, polyurea, polythiourea, polyurethane, polyester, polyazomethine, aluminum alkoxide, zinc alkoxide and titanium alkoxide.

11. The inkjet print head of claim 10, wherein the main body further comprises:

an ink injecting part configured to provide the ink to the space of the ink storage, and comprising a hole defined in the main body; and a nozzle part on a lower surface of the ink storage, and emitting the ink provided from the ink storage to an outside of the main body.

12. The inkjet print head of claim 11, further comprising:

a driving part on an outer surface of the main body, and configured to apply a power to the nozzle part such that the nozzle part emits the ink.

13. The inkjet print head of claim 11, wherein the nozzle part comprises:

a nozzle main body comprising the carbon allotrope and connected to the ink storage, and an opening which is defined in the nozzle main body and configured to store the ink; and a piezoelectric ceramic layer connected to the opening in the nozzle main body.

14. The inkjet print head of claim 13, wherein the nozzle part further comprises:

the protecting layer on an inner surface of the nozzle main body and the piezoelectric ceramic layer, and comprising parylene;

the inorganic layer on the protecting layer; and the organic layer on the inorganic layer.

15. A method of manufacturing an inkjet print head, comprising:

forming a protecting layer from a parylene dimer, on a surface of a main body comprising carbon allotrope;

depositing an inorganic layer on the protecting layer; and depositing an organic layer on the inorganic layer.

16. The method of claim 15, wherein the carbon allotrope is graphite.

17. The method of claim 15, further comprising:

coating an adhesive layer comprising at least one of 3-methacryloxypropyltrimethoxysilane and N-(2-aminoethyl)-3-aminopropyltrimethoxysilane, prior to the forming the protecting layer.

18. The method of claim 15, wherein the forming the protecting layer comprises:

heating the parylene dimer to decompose the parylene dimer into a parylene monomer; and polymerizing the parylene monomer on the surface of the main body.

19. The method of claim 15, wherein the inorganic layer is deposited by atomic layer deposition.

20. The method of claim 15, wherein the organic layer is deposited by molecular layer deposition.

* * * * *